US011242199B2

(12) United States Patent
Mitchell Witchell et al.

(10) Patent No.: US 11,242,199 B2
(45) Date of Patent: Feb. 8, 2022

(54) EXPANDABLE CONTRACTABLE RECYCLING BIN

(71) Applicant: Recyclaholics, LLC, Hudson, WI (US)

(72) Inventors: Lisa Beth Mitchell Witchell, Hudson, WI (US); Rodolfo Negrete, Buena Park, CA (US)

(73) Assignee: Recyclaholics, LLC, Hudson, WI (US)

( * ) Notice: Subject to any disclaimer, the term of this patent is extended or adjusted under 35 U.S.C. 154(b) by 162 days.

(21) Appl. No.: 16/460,578

(22) Filed: Jul. 2, 2019

(65) Prior Publication Data

US 2020/0189843 A1 Jun. 18, 2020

Related U.S. Application Data

(60) Provisional application No. 62/693,780, filed on Jul. 3, 2018.

(51) Int. Cl.
*B65F 1/14* (2006.01)
*B65F 1/00* (2006.01)

(52) U.S. Cl.
CPC ..... *B65F 1/14* (2013.01); *B65F 1/0033* (2013.01); *B65F 2001/0086* (2013.01); *B65F 2210/139* (2013.01); *B65F 2220/108* (2013.01); *B65F 2220/1063* (2013.01)

(58) Field of Classification Search
CPC ..... B65F 2220/108; B65F 2220/1063; B65F 1/14; B65F 1/0033; B65F 2210/139; B65F 2001/0086; B65F 1/0053; B65D 11/184; B65D 5/3628; B65D 5/3607
See application file for complete search history.

(56) References Cited

U.S. PATENT DOCUMENTS 5,725,310 A * 3/1998 Kruczko ..... B65D 5/6611 229/117.05
8,458,865 B1 * 6/2013 Williams ..... B65D 21/0205 24/555
2013/0125957 A1 * 5/2013 Kim ..... H01G 9/2068 136/251
2017/0090447 A1 * 3/2017 Skocypec ..... B65B 67/1238
2017/0320615 A1 * 11/2017 Izquierdo ..... B65D 5/40

* cited by examiner

*Primary Examiner* — Stephen J Castellano
(74) *Attorney, Agent, or Firm* — Meister Seelig & Fein LLP; Seth H. Ostrow, Esq.

(57) ABSTRACT

A modular receptacle system for storing refuse or recyclable materials, the modular receptacle system comprising a plurality of collapsible bins, a given one of the plurality of bins comprising a base, two opposing exposed side walls, each of the opposing exposed side walls including a bottom edge that allows the opposing exposed side wall to open or fold at a joint edge attached to the base, and two opposing folding side walls, the opposing folding side walls operable to detract or retract at least a portion of the opposing folding side walls from a recess in conjunction with an opening or folding of the opposing exposed side walls at the joint edge, the base and the opposing folding side walls including a mid-section fold that allows the base and folding side walls to open and fold at the mid-section fold, and a plurality of attachment devices that modularly couple the plurality of collapsible bins.

14 Claims, 4 Drawing Sheets

EXPANDABLE CONTRACTABLE RECYCLING BIN

CROSS REFERENCE TO RELATED APPLICATION

This application claims the priority of U.S. Provisional Application No. 62/693,780, entitled "EXPANDABLE CONTRACTABLE RECYCLING BIN," filed on Jul. 3, 2018, the disclosure of which is hereby incorporated by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Field of the Invention

This application generally relates to the collection of recyclable materials including difficult to recycle materials, and in particular, a materials-recycling collection assembly.

Description of the Related Art

With the increased concern and awareness for the environment throughout the world, recycling has become an accepted part of modern society. Many different common everyday items that can be recycled include: glass; metals; plastics; paper; and various other products. To this end, materials-recycling collection apparatus exist in the marketplace. Many of these are cumbersome, others are expensive to construct, and some are inadequate. What has long been needed is a materials-recycling collection bin assembly of simple, inexpensive construction, that can handle and/or keep separate any different type of waste material for recycling, and which may itself be easily recyclable as well. Therefore, any business, household or organization can achieve 100% zero waste using such an assembly.

SUMMARY OF THE INVENTION

The present invention provides a modular receptacle system for storing refuse or recyclable materials. According to one embodiment, the modular receptacle system comprises a plurality of collapsible bins, a given one of the plurality of bins comprising a base, two opposing exposed side walls, each of the opposing exposed side walls including a bottom edge that allows the opposing exposed side wall to open or fold at a joint edge attached to the base, and two opposing folding side walls, the opposing folding side walls operable to detract or retract at least a portion of the opposing folding side walls from a recess in conjunction with an opening or folding of the opposing exposed side walls at the joint edge, the base and the opposing folding side walls including a mid-section fold that allows the base and folding side walls to open and fold at the mid-section fold. The modular receptacle system further comprises a plurality of attachment devices that modularly couple the plurality of collapsible bins.

The given one of the plurality of bins may be compressible on the two opposing folding side walls along the mid-section fold and about respective joint edges of the two opposing folding side walls to the base such that each of the opposing folding side walls forms a 'W' shape in a collapsed configuration. According to another embodiment, portions of the two opposing folding side walls are folded into recesses in a collapsed configuration. The two opposing exposed side walls can be opened vertically at respective joint edges of the two opposing folding side walls thereby simultaneously causing unfolding of the two opposing folding side walls from the recesses and causing the two opposing folding side walls to open outward to expose an opening and the base. The mid-section fold may comprise a fold or crease through the two opposing folding side walls and the base. The fold or crease of the mid-section fold may be unfolded to cause the two opposing exposed side walls to be in a same plane. The two opposing folding side walls may further comprise retractable side wall portions.

The plurality of collapsible bins are attached to one another at exposed side wall sides. The plurality of collapsible bins can be attached using at least one of: magnets, clips, hooks, fasteners, hook and loop fasteners, and buttons. In one embodiment, any one of the two opposing exposed side walls or the two opposing folding side walls may include programmable or manually-switched lighting. The programmable or manually-switched lighting may also include a variety of colors. The programmable or manually-switched lighting may also include flashing or visual design effects. In another embodiment, solar sensitive dyes may be injected in printed patterns on walls of the plurality of collapsible bins. The plurality of collapsible bins may also be expanded horizontally.

BRIEF DESCRIPTION OF THE DRAWINGS

The invention is illustrated in the figures of the accompanying drawings which are meant to be exemplary and not limiting, in which like references are intended to refer to like or corresponding parts.

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized, and structural changes may be made without departing from the scope of the present invention. Likewise, a reasonably broad scope for claimed or covered subject matter is intended. Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part. The following detailed description is, therefore, not intended to be taken in a limiting sense.

The present application discloses an integrated device comprising a series of independently collapsible recycling bins or receptacles that may be constructed from material such as recycled plastic, paper, cardboard, metal, etc. Each bin may be independently collapsed and extended. For example, a person may expand a first bin to fill and then expand a second bin, as needed, while the others can stay collapsed. The bins may be opaque and include LED (light-emitting diode)/solar lighting to display certain colors for certain streams or types of materials being recycled.

Figure 1:
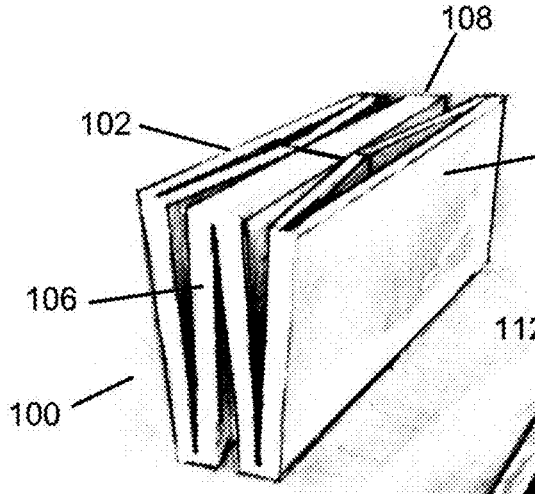
FIGS. 1 through 5 illustrate a collapsible bin according to an embodiment of the present invention.
Figure 2:
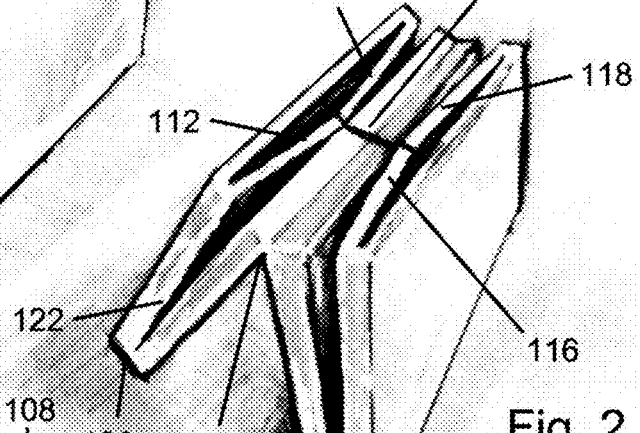

FIGS. 1 through 5 illustrate a collapsible bin according to an embodiment of the present invention. As shown in FIG. 1 and to some extent FIG. 2, bin 100 may be folded into a collapsed configuration. Bin 100 includes exposed side walls 102 and 104. A bottom edge of exposed side wall 102 is attached to base 130 by joint edge 126 and a bottom edge of exposed side wall 104 is attached to base 130 by joint edge 128. The bottom edges of folding side walls 106 and 108 are adjacent to base 130. Left and right edges of folding side walls 106 and 108 are adjacent to left and right edges of exposed side walls 102 and 104, accordingly.

The collapsed configuration allows for space saving when the bin is not in use. In the collapsed configuration, bin 100 is compressed on folding side walls 106 and 108 along mid-section fold 120, and about joint edges 126 and 128 such that each of folding side walls 106 and 108 forms a 'W' shape. The mid-section fold 120 comprises a fold or crease through side wall 106, side wall 108, and base 130 on the bottom of bin 100. Additionally, portions of side wall 106 and 108 are folded into recesses 122 and 124 in the collapsed configuration.

Figure 3:
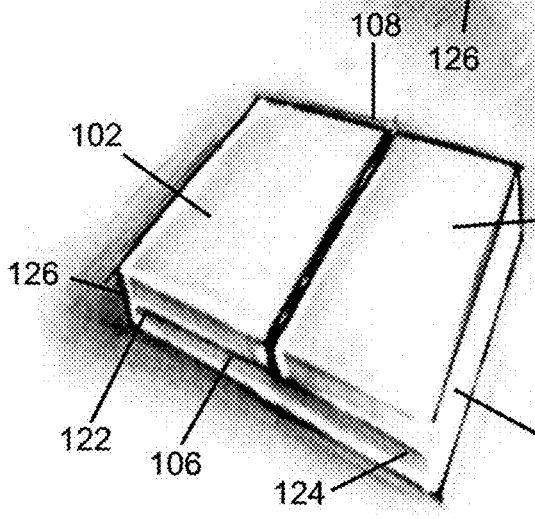
Figure 4:
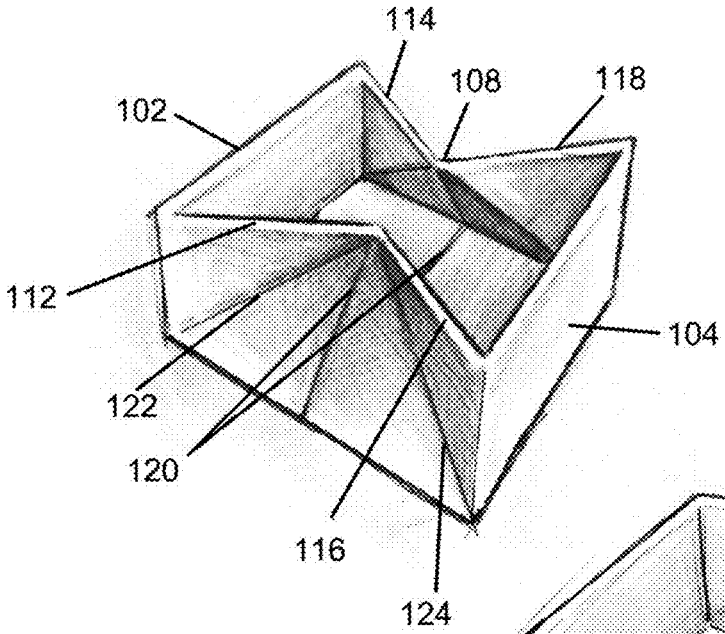

To expand bin 100, a user may unfold the crease of mid-section fold 120 to cause exposed side wall 102 to be in the same plane as exposed side wall 104 as shown in FIG. 3. FIG. 4 further depicts how both exposed side walls 102 and 104 may be opened vertically at joint edges 126 and 128 thereby simultaneously causing unfolding of the side walls 106, 108 from recesses 122 and 124 causing side walls 106 and 108 to open outward to expose opening 110 and base 130.

Figure 5:
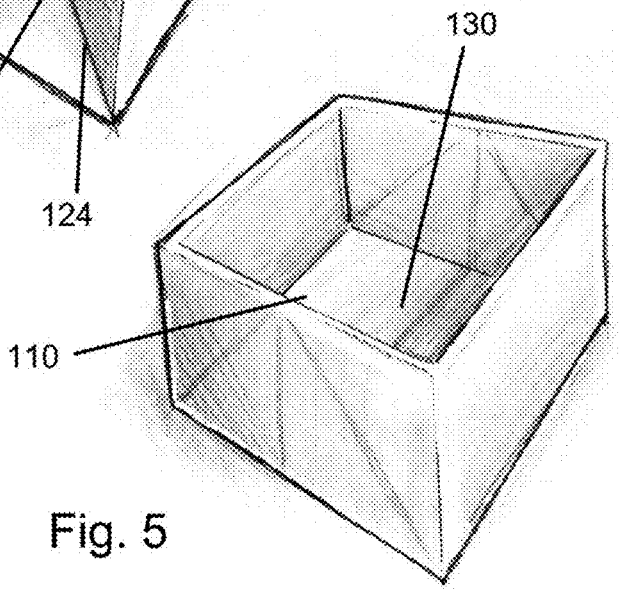

FIG. 5 presents bin 100 in a fully expanded configuration where exposed side wall 102 is substantially parallel to exposed side wall 104 while retractable side wall portion 112 is substantially parallel to retractable side wall portion 114, retractable side wall portion 116 is substantially parallel to retractable side wall portion 118, retractable side wall portion 112 is on the same plane as retractable side wall portion 116, and retractable side wall portion 114 is on the same plane as retractable side wall portion 118. Exemplary dimensions for bin 100 when in the expanded configuration may be 7.5" tall, 15" wide, and 15" long. In one embodiment, a reusable/wipeable box or lining may be placed inside bin 100 for easy emptying. The reusable/wipeable box or lining may cover base 130 as well as all the sidewalls.

Figure 6:
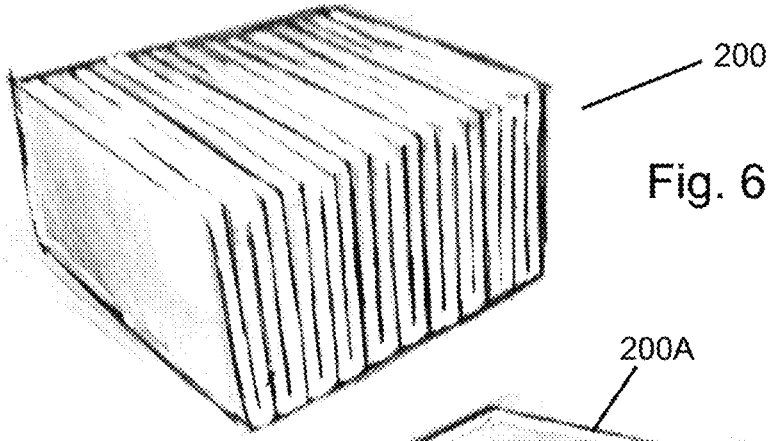
FIG. 6 illustrates a system of modular bins in a collapsed configuration according to an embodiment of the present invention.

FIG. 6 illustrates a system of modular bins in a collapsed configuration according to an embodiment of the present invention. Device 200 may comprise a plurality of independently collapsible bins. Each of the bins may be attached to one another at their exposed side walls. The bins may be attached via magnets, clips, hooks, fasteners, hook and loop fasteners, buttons, or any other devices known to one of ordinary skill in the art that would be suitable for attachment. In one embodiment, each bin may also be used as a cover for the other bins.

Figure 7:
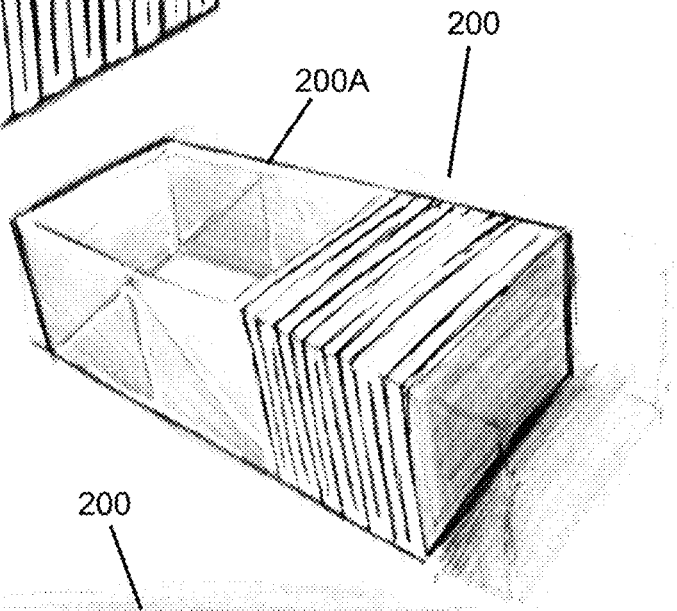
FIG. 7 through 9 illustrate expanded bins comprised in a system of modular bins according to an embodiment of the present invention.
Figure 8:
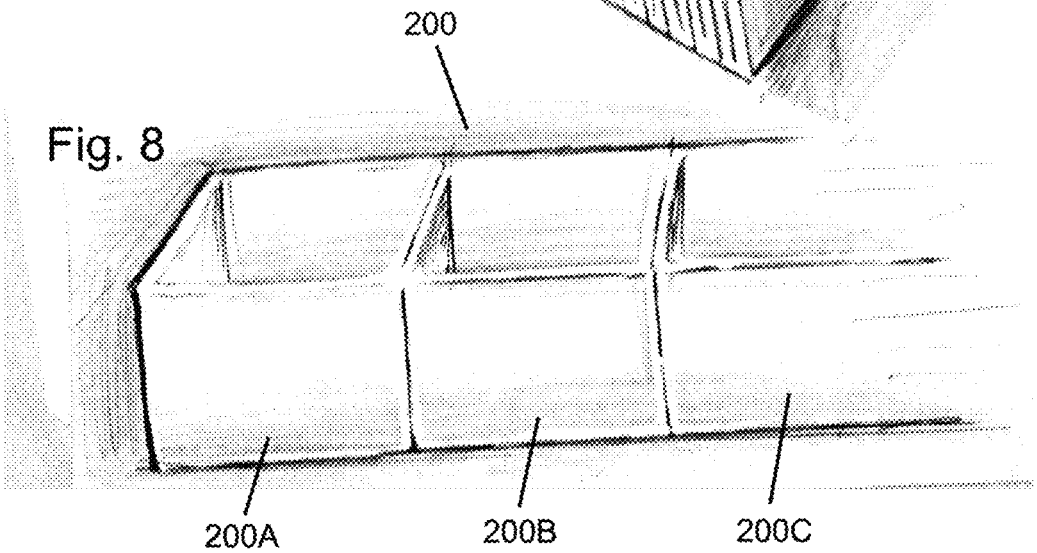
Figure 9:
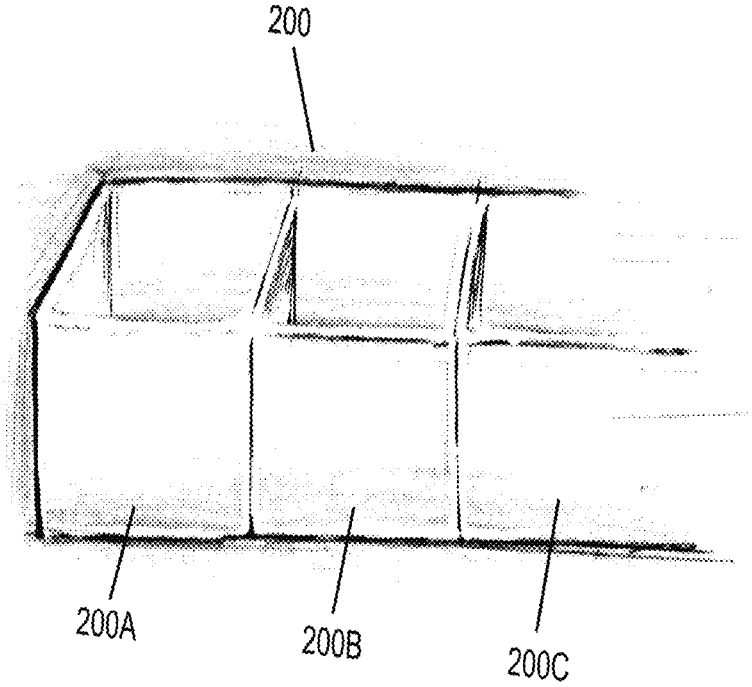

Each bin may be independently unfolded. As illustrated in FIG. 7, a first bin 200A may be expanded while the others can stay collapsed. However, any number of bins may be expanded as illustrated in FIG. 8 where first bin 200A, second bin 200B, and third bin 200C may all be simultaneously expanded. Alternatively, a bin may be replicated above itself (i.e., horizontally) in inverse fashion creating a container with double its original height, as illustrated in FIG. 9.

According to another embodiment, the side walls of the bins may be opaque and include solar LED lighting that may be programmable or manually-switched to display certain colors. The bins may be displayed in different colors, for example, to indicate separate bins for each stream of recycling or type of refuse. The color lights can flash and/or be turned on for a visual design effect as well. In addition, solar sensitive dyes may be used in situ of the LED mechanism. The dyes may produce illumination and color for decorating the interior and exterior walls of the bin. The dyes reacting with sunlight can reveal or accentuate existing design elements.

FIGS. 1 through 9 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

What is claimed is:

1. A modular receptacle system for storing refuse or recyclable materials, the modular receptacle system comprising:

a plurality of collapsible bins, a given one of the plurality of bins comprising:

a base, two opposing exposed side walls, each of the opposing exposed side walls including a bottom edge that allows the opposing exposed side wall to unfold or fold at a joint edge attached to the base, and two opposing folding side walls, the opposing folding side walls operable to fold into recesses under at least a portion of the opposing exposed side walls in conjunction with an unfolding or folding of the opposing exposed side walls at the joint edge, the base and the opposing folding side walls including a mid-section fold that allows the base and folding side walls to unfold and fold at the mid-section fold, wherein folding the opposing exposed side walls causes the top of the two exposed side walls to meet at the mid-section fold in parallel; and a plurality of attachment devices that modularly couple the plurality of collapsible bins.

2. The modular receptacle system of claim 1 wherein the given one of the plurality of bins is compressible on the two opposing folding side walls along the mid-section fold and about respective joint edges of the two opposing folding side walls to the base such that each of the opposing folding side walls forms a 'W' shape in a collapsed configuration.

3. The modular receptacle system of claim 1 wherein portions of the two opposing folding side walls are folded into recesses in a collapsed configuration.

4. The modular receptacle system of claim 3 wherein the two opposing exposed side walls are unfolded vertically at respective joint edges of the two opposing folding side walls thereby simultaneously causing unfolding of the two opposing folding side walls from the recesses and causing the two opposing folding side walls to expand outward to expose an open top and the base.

5. The modular receptacle system of claim 1 wherein the mid-section fold comprises a fold or crease through the two opposing folding side walls and the base.

6. The modular receptacle system of claim 1 wherein the given one of the plurality of collapsible bins is configurable such that the fold or crease of the mid-section fold is unfolded to cause the two opposing exposed side walls to be in a same plane.

7. The modular receptacle system of claim 1 wherein the two opposing folding side walls further comprise retractable side wall portions.

8. The modular receptacle system of claim 1 wherein the plurality of collapsible bins are attachable to each other at exposed side wall sides.

9. The modular receptacle system of claim 1 wherein the plurality of collapsible bins are attachable to each other using at least one of: magnets, clips, hooks, fasteners, hook and loop fasteners, and buttons.

10. The modular receptacle system of claim 1 wherein any one of the two opposing exposed side walls or the two opposing folding side walls includes programmable or manually-switched lighting.

11. The modular receptacle system of claim 10 wherein the programmable or manually-switched lighting includes a variety of colors.

12. The modular receptacle system of claim 10 wherein the programmable or manually-switched lighting includes flashing or visual design effects.

13. The modular receptacle system of claim 1 wherein any of the two opposing exposed side walls and the two opposing folding side walls include solar sensitive dyes.

14. The modular receptacle system of claim 1 wherein the plurality of collapsible bins are expanded horizontally.

* * * * *